US011662140B2

(12) United States Patent
Sakamoto et al.

(10) Patent No.: US 11,662,140 B2
(45) Date of Patent: May 30, 2023

(54) RAW MATERIAL GAS LIQUEFYING DEVICE AND METHOD OF CONTROLLING THIS RAW MATERIAL GAS LIQUEFYING DEVICE

(71) Applicant: KAWASAKI JUKOGYO KABUSHIKI KAISHA, Kobe (JP)

(72) Inventors: Tomohiro Sakamoto, Akashi (JP); Hidetaka Miyazaki, Kobe (JP); Naotaka Yamazoe, Akashi (JP); Daisuke Kariya, Kobe (JP); Yasuo Miwa, Kobe (JP); Yuichi Saitou, Akashi (JP); Yosuke Kimura, Kakogawa (JP); Toshihiro Komiya, Kakogawa (JP); Yoshihiro Matsuda, Kobe (JP); Keisuke Nakagawa, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 850 days.

(21) Appl. No.: 16/465,529

(22) PCT Filed: Dec. 4, 2017

(86) PCT No.: PCT/JP2017/043509
§ 371 (c)(1),
(2) Date: May 30, 2019

(87) PCT Pub. No.: WO2018/105564
PCT Pub. Date: Jun. 14, 2018

(65) Prior Publication Data

US 2019/0285339 A1 Sep. 19, 2019

(30) Foreign Application Priority Data

Dec. 8, 2016 (JP) ..... JP2016-238534

(51) Int. Cl.
*F25J 1/02* (2006.01)
*F25B 9/02* (2006.01)
*F25J 1/00* (2006.01)

(52) U.S. Cl.
CPC ..... *F25J 1/0204* (2013.01); *F25B 9/02* (2013.01); *F25J 1/001* (2013.01); *F25J 1/005* (2013.01);
(Continued)

(58) Field of Classification Search
CPC ... F25B 9/02; F25J 1/0067; F25J 1/005; F25J 1/10204; F25J 11/001; F25J 1/0243; F25J 1/0244; F25J 1/0247; F25J 2280/10
See application file for complete search history.

(56) References Cited

FOREIGN PATENT DOCUMENTS

JP 2016-176654 A 10/2016
JP 2016-183827 A 10/2016

*Primary Examiner* — John F Pettitt, III
(74) *Attorney, Agent, or Firm* — Oliff PLC

(57) ABSTRACT

A raw material gas liquefying device includes a feed line; a refrigerant circulation line; and a controller. In a refrigerant liquefaction route, a refrigerant flows through a compressor, a heat exchanger, a circulation system JT valve, a liquefied refrigerant storage tank, and the heat exchanger, and returns to the compressor. In a cryogenic energy generation route, the refrigerant flows through the compressor, the heat exchanger, an expansion unit, and the heat exchanger, and returns to the compressor. The controller determines if a refrigerant storage tank liquid level is within an allowable range, manipulates a feed system JT valve opening rate to control refrigerant temperature at the high-temperature-side refrigerant flow path exit side of the heat exchanger, and manipulates the opening rate of the feed system JT valve to control the refrigerant storage tank liquid level so that the refrigerant storage tank liquid level falls into the predetermined allowable range.

10 Claims, 8 Drawing Sheets

(52) U.S. Cl.
CPC ..... *F25J 1/0005* (2013.01); *F25J 1/0007* (2013.01); *F25J 1/0052* (2013.01); *F25J 1/0062* (2013.01); *F25J 1/0065* (2013.01); *F25J 1/0067* (2013.01); *F25J 1/0221* (2013.01); *F25J 1/0244* (2013.01); *F25J 1/0298* (2013.01); *F25J 2210/42* (2013.01); *F25J 2215/32* (2013.01); *F25J 2270/16* (2013.01)

RAW MATERIAL GAS LIQUEFYING DEVICE AND METHOD OF CONTROLLING THIS RAW MATERIAL GAS LIQUEFYING DEVICE

TECHNICAL FIELD

The present invention relates to a raw material gas liquefying device which liquefies a raw material gas to be liquefied at a cryogenic temperature, such as a hydrogen gas, and a method of controlling this raw material gas liquefying device.

BACKGROUND ART

For example, a raw material gas liquefying device which liquefies a raw material gas to be liquefied at a cryogenic temperature, such as a hydrogen gas, is conventionally known. Patent Literature 1 discloses this technique.

The raw material gas liquefying device disclosed in Patent Literature 1 has been conceived by the inventors of the present application, and is a prior art of the present application. FIG. 9 shows a conventional raw material gas liquefying device 200 disclosed in Patent Literature 1. As shown in FIG. 9, the raw material gas liquefying device 200 disclosed in Patent Literature 1 includes a feed line 1 which flows therethrough a raw material gas (e.g., hydrogen gas), and a refrigerant circulation line 3 which flows therethrough a refrigerant (e.g., hydrogen gas) for cooling the raw material gas. The raw material gas liquefying device 200 includes heat exchangers 81 to 86 which exchange heat between the raw material gas in the feed line 1 and the refrigerant in the refrigerant circulation line 3, and a cooler 88 which cools the raw material gas with a liquefied refrigerant stored (reserved) in a liquefied refrigerant storage tank 40.

The feed line 1 passes through the heat exchangers 81 to 86, the cooler 88, and a feed system Joule-Thomson valve (hereinafter will be referred to as "feed system JT valve 16") in this order. The raw material gas which has been compressed (whose pressure has been increased) by a compressor or the like (not shown) and has a high pressure is introduced into the feed line 1. In the feed line 1, the raw material gas is cooled by the heat exchangers 81 to 86 and the cooler 88 while flowing through them, and is liquefied by Joule-Thomson (isenthalpic) expansion at the feed system JT valve 16. In this way, the liquefied raw material gas is produced.

The refrigerant circulation line 3 includes two circulation flow paths which partially overlap with each other, which are a refrigerant liquefaction route 41 and a cryogenic (cold) energy generation route 42. The refrigerant liquefaction route 41 passes through a low-pressure-side compressor (hereinafter will be referred to as "low-pressure compressor 32"), a high-pressure-side compressor (hereinafter will be referred to as "high-pressure compressor 33"), the heat exchangers 81 to 86, a circulation system Joule-Thomson valve (hereinafter will be referred to as "circulation system JT valve 36", the liquefied refrigerant storage tank 40, and the heat exchangers 86 to 81 in this order and returns to the low-pressure compressor 32. In the refrigerant liquefaction route 41, the refrigerant is compressed by the compressors 32, 33, is cooled by the heat exchangers 81 to 86, is liquefied by Joule-Thomson expansion at the circulation system JT valve 36, and thereafter flows into the liquefied refrigerant storage tank 40. The temperature of a boil-off gas of the liquefied refrigerant, which is generated in the liquefied refrigerant storage tank 40, is raised while the boil-off gas is flowing through the heat exchangers 81 to 86. Then, the boil-off gas returns to an entrance of the low-pressure compressor 32. The cryogenic energy generation route 42 passes through the high-pressure compressor 33, the heat exchangers 81, 82, a high-pressure-side expansion unit (hereinafter will be referred to as "high-pressure expansion unit 37"), the heat exchanger 84, a low-pressure-side expansion unit (hereinafter will be referred to as "low-pressure expansion unit 38"), and the heat exchangers 85 to 81, in this order, and thereafter returns to the high-pressure compressor 33. The refrigerant liquefaction route 41 and the cryogenic energy generation route 42 share the flow paths in a range from the high-pressure compressor 33 to the heat exchanger 82 at a second stage. A portion of the refrigerant, which exits the heat exchanger 82 at the second stage, flows to the cryogenic energy generation route 42. In the cryogenic energy generation route 42, the refrigerant flows through the expansion units 37, 38, and is changed into a low-temperature gas. The temperature of this low-temperature gas is raised while the low-temperature gas is flowing through the heat exchangers 85 to 81. Thereafter, the gas returns to an entrance of the high-pressure compressor 33.

The process of the raw material gas liquefying device 200 is controlled by a controller 6. The controller 6 obtains process data (e.g., flow rates, pressures, and temperatures of the raw material gas and the refrigerant, a liquid level in the liquefied refrigerant storage tank 40, rotation speeds and the like of the compressors 32, 33 and the expansion units 37, 38) in the feed line 1 and the refrigerant circulation line), and controls opening rates (opening degrees) of a bypass valve 34 and the JT valves 16, 36, based on the process data.

In the raw material gas liquefying device 200 disclosed in Patent Literature 1, the opening rate (opening degree) of the feed system JT valve 16 is adjusted so that the temperature of the refrigerant at an exit side of the low-pressure expansion unit 38 reaches a predetermined set value, to control the amount of raw material gas to be liquefied. In this way, the refrigerant temperature and the amount of raw material gas to be liquefied are controlled to keep a balance so that cryogenic energy insufficiency and excessive cooling for the raw material gas do not take place. In the raw material gas liquefying device 200 disclosed in Patent Literature 1, a bypass flow path 31*b* which bypasses the high-pressure compressor 33 is provided, and the bypass valve 34 is provided on the bypass flow path 31*b*. The opening rate of the bypass valve 34 is adjusted so that the detected pressure of the refrigerant at an exit side of the high-pressure compressor 33 reaches a predetermined pressure. This makes it possible to control the amount of the refrigerant circulated through the refrigerant circulation line 3.

CITATION LIST

Patent Literature

Patent Literature 1: Japanese-Laid Open Patent Application Publication No. 2016-176654

SUMMARY OF INVENTION

Technical Problem

In general, in the Joule-Thomson valve, a liquefaction yield changes depending on the entrance temperature or the entrance pressure (specifically, temperature and pressure at which isenthalpic expansion is initiated). As the entrance temperature is lower, the liquefaction yield is higher. In the raw material gas liquefying device 200 disclosed in Patent Literature 1, if the entrance pressure or the entrance temperature of the circulation system JT valve 36 changes, the liquefaction yield in the circulation system JT valve 36 changes. With the change of the liquefaction yield in the circulation system JT valve 36, it is difficult to stabilize the liquid level in the liquefied refrigerant storage tank 40, which causes a disorder of a cycle balance. Once the cycle balance is disordered, it is not easily restored. Patent Literature 1 does not specifically describe a control for the opening rate of the circulation system JT valve 36 and a control for the liquid level in the liquefied refrigerant storage tank 40.

An object of the present invention is to realize stable production of a liquefied raw material gas by keeping a good cycle balance while stabilizing a liquid level in a liquefied refrigerant storage tank in a raw material gas liquefying device.

Solution to Problem

According to an aspect of the present invention, a raw material gas liquefying device comprises a feed line in which a raw material gas flows through a raw material flow path of a heat exchanger, a liquefied refrigerant storage tank which stores a liquefied refrigerant therein, and a feed system Joule-Thomson valve in this order; a refrigerant circulation line including a refrigerant liquefaction route and a cryogenic energy generation route, wherein in the refrigerant liquefaction route, a refrigerant flows through a compressor, a high-temperature-side refrigerant flow path of the heat exchanger, a circulation system Joule-Thomson valve, the liquefied refrigerant storage tank, and a first low-temperature-side refrigerant flow path of the heat exchanger in this order, and returns to the compressor, while in the cryogenic energy generation route, the refrigerant flows through the compressor, an expansion unit, and a second low-temperature-side refrigerant flow path of the heat exchanger in this order, and returns to the compressor; a temperature sensor which detects a temperature of the refrigerant at an exit side of the high-temperature-side refrigerant flow path of the heat exchanger or a temperature of the raw material gas at an exit side of the raw material flow path of the heat exchanger; a liquid level sensor which detects a refrigerant storage tank liquid level which is a liquid level in the liquefied refrigerant storage tank; and a controller which determines whether or not the refrigerant storage tank liquid level is within a predetermined allowable range, manipulates an opening rate of the feed system Joule-Thomson valve to control the temperature detected by the temperature sensor so that the temperature reaches a predetermined temperature set value in a case where the refrigerant storage tank liquid level is within the predetermined allowable range, and manipulates the opening rate of the feed system Joule-Thomson valve to control the refrigerant storage tank liquid level so that the refrigerant storage tank liquid level falls into the predetermined allowable range in a case where the refrigerant storage tank liquid level is outside the predetermined allowable range.

According to an aspect of the present invention, there is provided a method of controlling a raw material gas liquefying device including: a feed line in which a raw material gas flows through a raw material flow path of a heat exchanger, a liquefied refrigerant storage tank which stores a liquefied refrigerant therein, and a feed system Joule-Thomson valve in this order; and a refrigerant circulation line including a refrigerant liquefaction route and a cryogenic energy generation route, wherein in the refrigerant liquefaction route, a refrigerant flows through a compressor, a high-temperature-side refrigerant flow path of the heat exchanger, a circulation system Joule-Thomson valve, the liquefied refrigerant storage tank, and a first low-temperature-side refrigerant flow path of the heat exchanger in this order, and returns to the compressor, while in the cryogenic energy generation route, the refrigerant flows through the compressor, an expansion unit, and a second low-temperature-side refrigerant flow path of the heat exchanger in this order, and returns to the compressor, the method comprising: manipulating an opening rate of the feed system Joule-Thomson valve to control a refrigerant storage tank liquid level which is a liquid level in the liquefied refrigerant storage tank so that the refrigerant storage tank liquid level falls into a predetermined allowable range, in a case where the refrigerant storage tank liquid level is outside the predetermined allowable range; and manipulating the opening rate of the feed system Joule-Thomson valve to control a temperature of the refrigerant at an exit side of the high-temperature-side refrigerant flow path of the heat exchanger or a temperature of the raw material gas at an exit side of the raw material flow path of the heat exchanger so that the temperature reaches a predetermined temperature set value, in a case where the refrigerant storage tank liquid level is within the predetermined allowable range.

In accordance with the raw material gas liquefying device and the method of controlling the raw material gas liquefying device, described above, the refrigerant storage tank liquid level is controlled to fall into the predetermined allowable range in a case where the refrigerant storage tank liquid level is outside the predetermined allowable range. In brief, the refrigerant storage tank liquid level is preferentially controlled to fall into the predetermined allowable range in a case where the refrigerant storage tank liquid level is outside the predetermined allowable range. This allows the refrigerant storage tank liquid level to quickly fall into the predetermined allowable range irrespective of the initial position of the refrigerant storage tank liquid level. Thus, the refrigerant storage tank liquid level is easily stabilized.

Also, in accordance with the above-described raw material gas liquefying device and the method of controlling the raw material gas liquefying device, described above, in a case where the refrigerant storage tank liquid level is within the predetermined allowable range, the temperature of the refrigerant at the exit side of the heat exchanger or the temperature of the raw material gas at the exit side of the heat exchanger is controlled so that the temperature is held at the temperature set value, and the temperature of the refrigerant at the exit side of the heat exchanger is stabilized. This makes it possible to stabilize the temperature at the entrance of the circulation system Joule-Thomson valve, and stabilize the liquefaction yield in the circulation system Joule-Thomson valve. As a result, the refrigerant storage tank liquid level can be stabilized. In this way, to realize a good cycle balance, the cryogenic (cold) energy generated in the cryogenic energy generation route is distributed to the refrigerant liquefaction route and the feed line. Therefore, a good cycle balance can be kept while stabilizing the liquid level in the liquefied refrigerant storage tank, which leads to stable production of the liquefied raw material gas.

Advantageous Effects of Invention

In accordance with the present invention, in a raw material gas liquefying device, production of a liquefied raw material gas can be stabilized by keeping a good cycle balance while stabilizing a liquid level in a liquefied refrigerant storage tank.

DESCRIPTION OF EMBODIMENTS

Figure 1:
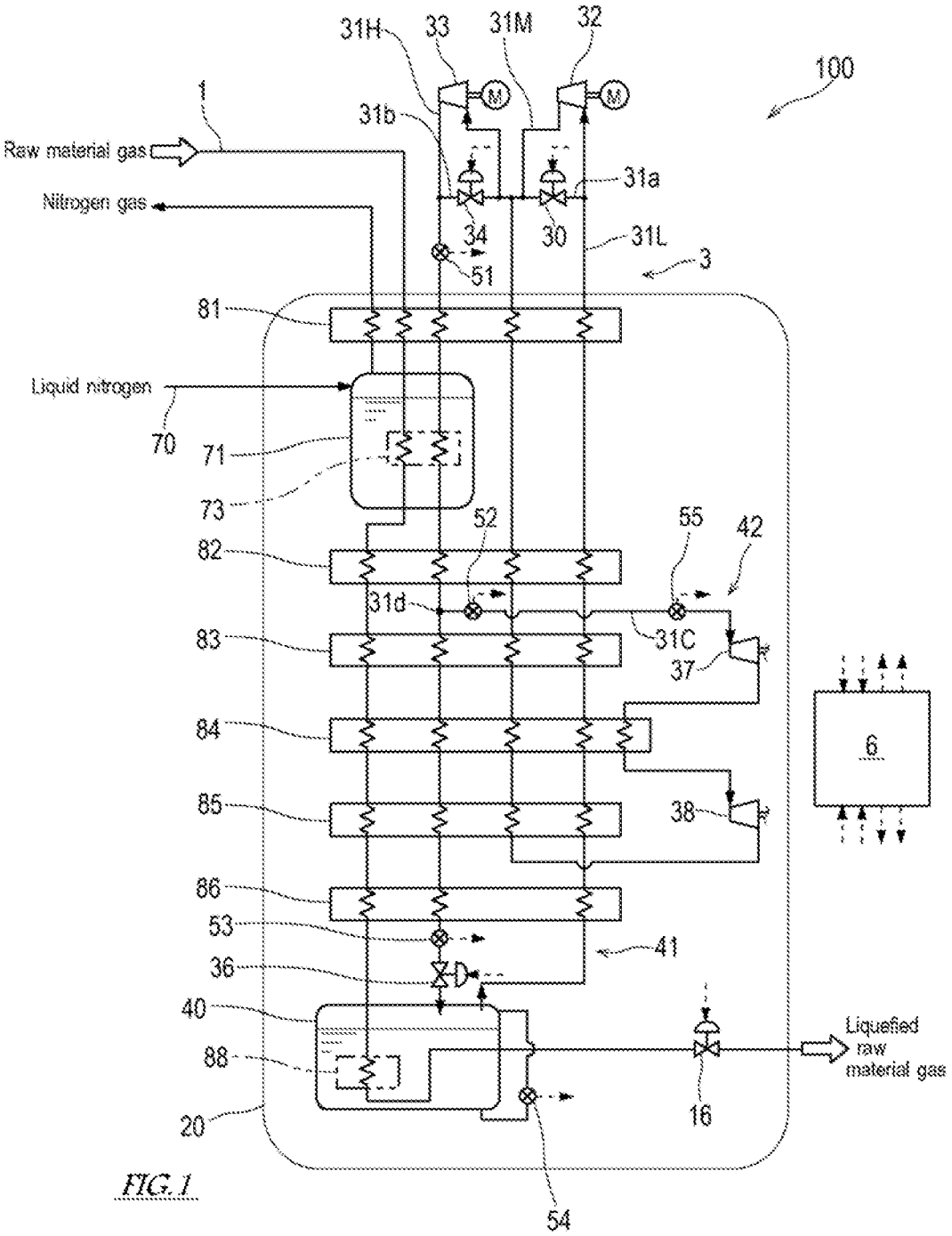
FIG. 1 is a view showing the overall configuration of a raw material gas liquefying device according to one embodiment of the present invention.
Figure 2:
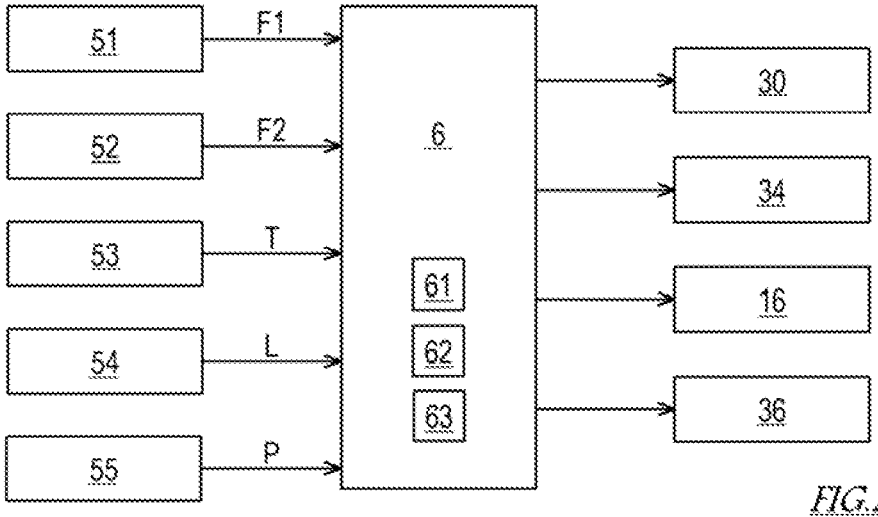
FIG. 2 is a block diagram showing the configuration of a control system of the raw material gas liquefying device.

Hereinafter, the embodiment of the present invention will be described with reference to the drawings. FIG. 1 is a view showing the overall configuration of a raw material gas liquefying device 100 according to one embodiment of the present invention. FIG. 2 is a block diagram showing the configuration of a control system of the raw material gas liquefying device 100. The raw material gas liquefying device 100 according to the present embodiment is configured to cool and liquefy a raw material gas supplied to the raw material gas liquefying device 100 to generate a liquefied raw material gas. In the present embodiment, a high-purity hydrogen gas is used as the raw material gas. As the liquefied raw material gas, liquid hydrogen is generated. However, the raw material gas is not limited to the hydrogen gas so long as the raw material gas is in a gaseous state at a room temperature and a normal pressure and its boiling temperature is lower than that (minus 196 degrees C.) of a nitrogen gas. As the raw material gas, for example, there are the hydrogen gas, a helium gas, and a neon gas.

As shown in FIGS. 1 and 2, the raw material gas liquefying device 100 includes a feed line 1 which flows the raw material gas therethrough, a refrigerant circulation line 3 which circulates a refrigerant therethrough, and a controller 6 which controls the operation of the raw material gas liquefying device 100. The raw material gas liquefying device 100 includes heat exchangers 81 to 86 at multiple stages, which exchange beat between the raw material gas flowing through the feed line 1 and the refrigerant flowing through the refrigerant circulation line 3, and coolers 73, 88.

[Configuration of Feed Line 1]

The feed line 1 is a flow path which flows the raw material gas therethrough. The feed line 1 includes high-temperature-side flow paths (raw material flow paths) inside the heat exchangers 81 to 86, flow paths inside the coolers 73, 88, a feed system Joule-Thomson valve (hereinafter will be referred to as "feed system JT valve 16"), flow paths inside pipes connecting them to each other, and the like. The raw material gas with a room temperature and a normal pressure, which has been compressed (whose pressure has been increased) by a compressor (not shown) or the like, is fed to the feed line 1.

The feed line 1 passes through the heat exchanger 81 at a first stage, the cooler 73 for preliminary cooling, the heat exchangers 82 to 86 at second to sixth stages, the cooler 88, and the feed system JT valve 16 in this order. In the heat exchangers 81 to 86, heat exchange between the raw material gas and the refrigerant takes place. In this way, the raw material gas is cooled.

The feed line 1 passes through the heat exchanger 81 at the first stage and then through the cooler 73, before it enters the heat exchanger 82 at the second stage. The cooler 73 for preliminary cooling includes a liquid nitrogen storage tank 71 storing liquid nitrogen therein, and a nitrogen line 70 which externally feeds the liquid nitrogen to the liquid nitrogen storage tank 71. The feed line 1 extends through the inside of the liquid nitrogen storage tank 71. The cooler 73 for preliminary cooling cools the raw material gas to a temperature that is almost equal to that of the liquid nitrogen.

The feed line 1 passes through the heat exchanger 86 at the sixth stage and then through the cooler 88, before it enters the feed system JT valve 16. The cooler 88 includes a liquefied refrigerant storage tank 40 which stores therein a liquefied refrigerant generated by liquefying the refrigerant in the refrigerant circulation line 3. The feed line 1 extends through the inside of the liquefied refrigerant storage tank 40. The cooler 88 cools the raw material gas to a temperature that is approximately equal to a temperature (specifically, cryogenic temperature) of the liquefied refrigerant, with the liquefied refrigerant stored in the liquefied refrigerant storage tank 40.

The raw material gas with the cryogenic temperature exits the cooler 88 and then flows into the feed system JT valve 16. At the feed system JT valve 16, the raw material gas with the cryogenic temperature is liquefied to liquid with a low temperature and a normal pressure, by Joule-Thomson expansion. The raw material gas (liquefied raw material gas) liquefied in this way is sent to a storage tank (not shown) and stored therein. The generation amount (liquefaction amount) of the liquefied raw material gas is adjusted according to the opening rate (opening degree) of the feed system JT valve 16.

[Configuration of Refrigerant Circulation Line 3]

The refrigerant circulation line 3 is a closed flow path which circulates the refrigerant therethrough. The refrigerant circulation line 3 includes flow paths inside the heat exchangers 81 to 86, flow path inside the cooler 73, two compressors 32, 33, two expansion units 37, 38, a circulation system Joule-Thomson valve (hereinafter will be referred to as "circulation system JT valve 36"), the liquefied refrigerant storage tank 40, flow paths inside pipes connecting them, and the like.

A filling line (not shown) for filling the refrigerant is connected to the refrigerant circulation line 3. In the present embodiment, hydrogen is used as the refrigerant. However, the refrigerant is not limited to hydrogen and may be any substance which is in a gaseous state at a room temperature and a normal pressure, and whose boiling temperature is equal to or lower than that of the raw material gas. As the refrigerant, for example, there are hydrogen, helium, and neon.

The refrigerant circulation line 3 includes two circulation flow paths (closed loop) which are a refrigerant liquefaction route 41 and a cryogenic energy (cold energy) generation route 42 which partially share flow paths.

The refrigerant liquefaction route 41 passes through the low-pressure-side compressor (hereinafter will be referred to as "low-pressure compressor 32"), the high-pressure-side compressor (hereinafter will be referred to as "high-pressure compressor 33"), a high-temperature-side refrigerant flow path of the heat exchanger 81 at the first stage, the cooler 73 for preliminary cooling, high-temperature-side refrigerant flow paths of the heat exchangers 82 to 86 at the second to sixth stages, the circulation system JT valve 36, the liquefied refrigerant storage tank 40, and low-temperature-side refrigerant flow paths of the heat exchangers 86 to 81 at the sixth to first stages in this order, and then returns to the low-pressure compressor 32.

A low-pressure flow path 31L is connected to the entrance of the low-pressure compressor 32. The exit of the low-pressure compressor 32 and the entrance of the high-pressure compressor 33 are connected to each other by a medium-pressure flow path 31M. The refrigerant in the low-pressure flow path 31L is compressed by the low-pressure compressor 32 and discharged to the medium-pressure flow path 31M. The exit of the high-pressure compressor 33 and the entrance of the circulation system JT valve 36 are connected to each other via a high-pressure flow path 31H. The refrigerant in the medium-pressure flow path 31M is compressed by the high-pressure compressor 33 and discharged to the high-pressure flow path 31H.

The low-pressure flow path 31L and the medium-pressure flow path 31M are connected to each other via a first bypass flow path 31*a* which does not pass through the low-pressure compressor 32. The first bypass flow path 31*a* is provided with a first bypass valve 30. The medium-pressure flow path 31M and the high-pressure flow path 31H are connected to each other via a second bypass flow path 31*b* which does not pass through the high-pressure compressor 33. The second bypass flow path 31*b* is provided with a second bypass valve 34.

The refrigerant in the high-pressure flow path 31H flows through the high-temperature-side refrigerant flow path of the heat exchanger 81 at the first stage, the cooler 73 for preliminary cooling, and the high-temperature-side refrigerant flow paths of the heat exchangers 82 to 86 at the second to sixth stages, in this order, and is cooled. Then, the refrigerant flows into the circulation system JT valve 36. The refrigerant is liquefied by Joule-Thomson expansion at the circulation system JT valve 36. The liquefied refrigerant flows into the liquefied refrigerant storage tank 40. The generation amount (liquefaction amount) of the liquefied refrigerant is adjusted according to the opening rate (opening degree) of the circulation system JT valve 36.

In the liquefied refrigerant storage tank 40 which stores the liquefied refrigerant therein, a boil-offgas is generated. This boil-off gas flows into the low-pressure flow path 31L connecting the exit of the liquefied refrigerant storage tank 40 to the entrance of the low-pressure compressor 32. The low-pressure flow path 31L passes through the heat exchangers 81 to 86 at the first to sixth stages in an order which is the reverse of the order in which the high-pressure flow path 31H passes. Specifically, the low-pressure flow path 31L passes through the heat exchanger 86 at the sixth stage to the heat exchanger 81 at the first stage in this order. The temperature of the refrigerant in the low-pressure flow path 31L is increased while flowing through the low-temperature-side refrigerant flow paths of the heat exchangers 86 to 81. Then, the refrigerant returns to the entrance of the low-pressure compressor 32.

The cryogenic energy generation route 42 passes through the high-pressure compressor 33, the high-temperature-side refrigerant flow paths of the heat exchangers 81, 82 at the first and second stages, the high-pressure-side expansion unit (hereinafter will be referred to as "high-pressure expansion unit 37"), the heat exchanger 84 at the fourth stage, the low-pressure-side expansion unit (hereinafter will be referred to as "low-pressure expansion unit 38"), and the heat exchangers 85 to 81 at the fifth to first stages in this order, and then returns to the high-pressure compressor 33.

The refrigerant liquefaction route 41 and the cryogenic energy generation route 42 share the flow paths in a range from the high-pressure compressor 33 to the heat exchanger 82 at the second stage. A branch part 31*d* is provided at the high-pressure flow path 31H at a location that is between the exit of the heat exchanger 82 at the second stage and the entrance of the heat exchanger 83 at the third stage. The upstream end of a cryogenic energy generation flow path 31C is connected to the branch part 31*d*. The downstream end of the cryogenic energy generation flow path 31C is connected to the medium-pressure flow path 31M.

In a range from the branch part 31*d* to the medium-pressure flow path 31M, the cryogenic energy generation flow path 31C passes through the high-pressure expansion unit 37, the heat exchanger 84 at the fourth stage, the low-pressure expansion unit 38, and the low-temperature-side refrigerant flow paths of the heat exchangers 85 to 81 at the fifth to first stages. A most part of the refrigerant which has passed through the heat exchanger 82 at the second stage in the high-pressure flow path 31H flows to the cryogenic energy generation flow path 31C by the operation of the high-pressure expansion unit 37, and the remaining refrigerant flows to the heat exchanger 83 at the third stage.

The refrigerant which has flowed into the cryogenic energy generation flow path 31C and has a temperature lower than that of the liquid nitrogen and a high pressure, is expanded by the high-pressure expansion unit 37 so that its pressure and temperature are reduced, flows through the heat exchanger 84 at the fourth stage, and is expanded by the low-pressure expansion unit 38 so that its pressure and temperature are further reduced. The refrigerant with a cryogenic temperature exits the low-pressure expansion unit 38, and then flows through the heat exchanger 85 at the fifth stage to the heat exchanger 81 at the first stage in this order (in other words, cools the raw material gas and the refrigerant in the high-pressure flow path 31H), and joins the refrigerant in the medium-pressure flow path 31M.

Note that in the feed line 1 and the refrigerant circulation line 3, a section including the heat exchangers 81 to 86 at the first to sixth stages, the cooler 73 for preliminary cooling, the cooler 88, and the expansion units 37, 38 is constructed as a liquefier 20.

[Configuration of Control System of Raw Material Gas Liquefying Device 100]

The feed line 1 and the refrigerant circulation line 3 are provided with sensors for detecting process data in the raw material gas liquefying device 100. The refrigerant circulation line 3 is provided with a flow rate sensor 51 which detects a flow rate F1 of the refrigerant flowing through the refrigerant circulation line 3, at a location that is upstream of the heat exchanger 86 at the first stage in the high-pressure flow path 31H and where the refrigerant liquefaction route 41 and the cryogenic energy generation route 42 share the flow paths. A flow rate sensor 52 which detects a flow rate F2 of the refrigerant at the entrance of the high-pressure expansion unit 37 is provided at an upstream portion of the cryogenic energy generation flow path 31C. In brief, the flow rate F1 is a sum of the flow rate of the refrigerant flowing through the refrigerant liquefaction route 41 and the flow rate of the refrigerant flowing through the cryogenic energy generation route 42, while the flow rate F2 is the flow rate of the refrigerant flowing through the cryogenic energy generation route 42.

In the high-pressure flow path 31H, a temperature sensor 53 which detects a refrigerant temperature T at the exit side of the high-temperature-side refrigerant flow paths of the heat exchangers 81 to 86 is provided at the exit side of the high-pressure-side refrigerant flow paths of the heat exchangers 81 to 86. It is sufficient that the temperature sensor 53 is provided in a flow path connecting the exit of the heat exchanger 86 at a final stage (sixth stage in the present embodiment) to the entrance of the circulation system JT valve 36. The temperature sensor 53 may detect a refrigerant temperature at the entrance of the circulation system JT valve 36, instead of the refrigerant temperature T at the exit side of the high-temperature-side refrigerant flow paths of the heat exchangers 81 to 86.

The liquefied refrigerant storage tank 40 is provided with a liquid level sensor 54 which detects a liquid level (hereinafter will be referred to as "refrigerant storage tank liquid level L") of the liquefied refrigerant stored (reserved) in the liquefied refrigerant storage tank 40. The cryogenic energy generation flow path 31C is provided with a pressure sensor 55 which detects a pressure P of the refrigerant at the entrance of the high-pressure expansion unit 37. The flow rate sensor 51, the flow rate sensor 52, the temperature sensor 53, the liquid level sensor 54, and the pressure sensor 55 are connected via wires or wirelessly to the controller 6 so that these sensors can transmit detection values to the controller 6.

The controller 6 controls the opening rates of the first bypass valve 30, the second bypass valve 34, the circulation system JT valve 36, and the feed system JT valve 16. The controller 6 includes a feed system JT valve opening rate control section 61 which controls the opening rate (opening degree) of the feed system JT valve 16, a circulation system JT valve opening rate control section 62 which controls the opening rate of the circulation system JT valve 36, and a bypass valve opening rate control section 63 which controls the opening rates of the first bypass valve 30 and the second bypass valve 34. The controller 6 is a computer. The controller 6 is configured to execute pre-stored programs to operate as the feed system JT valve opening rate control section 61, the circulation system JT valve opening rate control section 62, and the bypass valve opening rate control section 63. These functional blocks are configured to derive the opening rate of the valve based on the obtained process data, and output an opening rate command to this valve.

[Processing Performed by Bypass Valve Opening Rate Control Section 63]

In the raw material gas liquefying device 100 with the above-described configuration, when a pressure in the refrigerant circulation line 3 changes, an entrance pressure in the circulation system JT valve 36 changes. For this reason, a liquefaction yield in the circulation system JT valve 36 becomes unstable, and the liquid level in the liquefied refrigerant storage tank 40 may tend to become unstable. To avoid this, the bypass valve opening rate control section 63 controls the opening rates (opening degrees) of the first bypass valve 30 and the second bypass valve 34 based on the detection value of the pressure sensor (not shown) which measures the refrigerant pressure in the high-pressure flow path 31H so that the refrigerant pressure in the high-pressure flow path 31H reaches a predetermined pressure.

[Processing Performed by Circulation System JT Valve Opening Rate Control Section 62]

In the raw material gas liquefying device 100, when a ratio of the refrigerant flowing to the cryogenic energy generation flow path 31C which branches off from the high-pressure flow path 31H, with respect to the refrigerant flowing through the high-pressure flow path 31H, in the refrigerant circulation line 3 (or a flow rate ratio of the flow rate in the cryogenic energy generation route 42, with respect to a sum of the flow rate in the refrigerant liquefaction route 41 and the flow rate in the cryogenic energy generation route 42 in the refrigerant circulation line 3) changes, the amount of cryogenic energy (cold energy) generated in the cryogenic energy generation route 42 changes. When the amount of cryogenic energy generated in the refrigerant liquefaction route 41 changes, the entrance temperature in the circulation system JT valve 36 changes. As a result, the liquefaction yield in the circulation system JT valve 36 becomes unstable, and the liquid level in the liquefied refrigerant storage tank 40 tends to become unstable. To avoid this, the circulation system JT valve opening rate control section 62 controls the opening rate of the circulation system JT valve 36 so that the amount of cryogenic energy generated in the cryogenic energy generation route 42 becomes constant.

Figure 3:
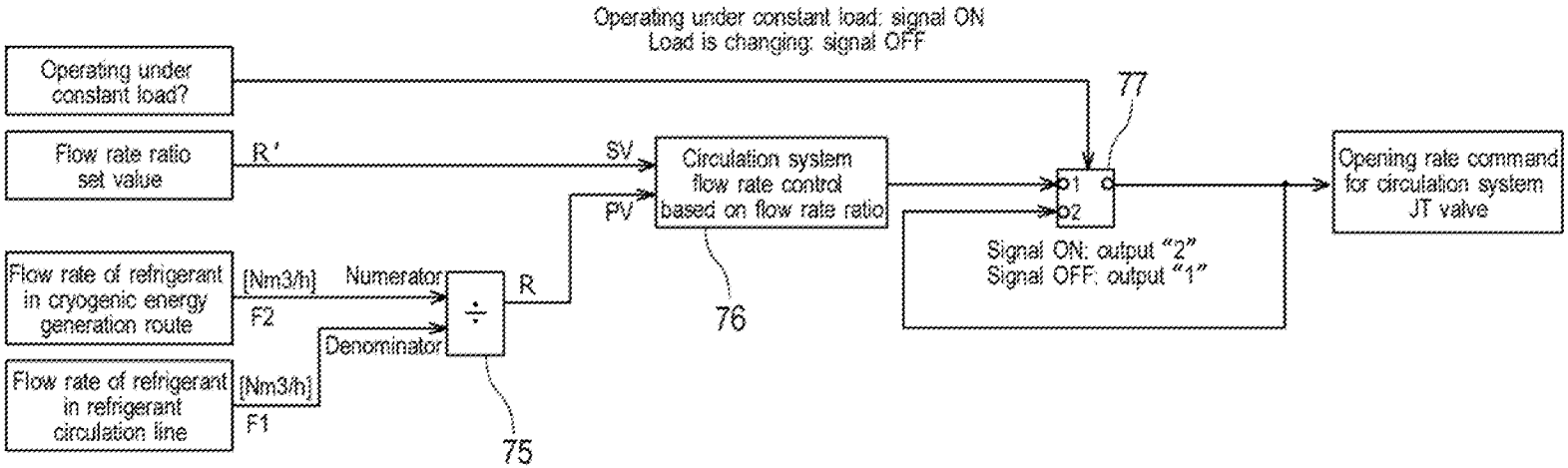
FIG. 3 is a view for explaining a flow of processing performed by a circulation system JT valve opening rate control section.

FIG. 3 is a view for explaining a flow of the processing performed by the circulation system JT valve opening rate control section 62. As shown in FIG. 3, the circulation system JT valve opening rate control section 62 of the controller 6 includes a divider 75, a circulation system flow rate control unit 76 corresponding to the flow rate ratio, and a switch 77.

The divider 75 obtains the flow rate F1 of the refrigerant at the entrance of the heat exchanger 81 at the first stage in the high-pressure flow path 31H, and the flow rate F2 of the refrigerant at the entrance of the high-pressure expansion unit 37 in the cryogenic energy generation flow path 31C, and calculates a ratio of the refrigerant flowing to the cryogenic energy generation route 42 with respect to the refrigerant flowing through the refrigerant circulation line 3, based on the flow rate F and the flow rate F2. Specifically, the divider 75 calculates the flow rate ratio R in which the flow rate F1 is a denominator and the flow rate F2 is a numerator, and outputs the flow rate ratio R to the circulation system flow rate control unit 76. The flow rate ratio R refers to a ratio of the refrigerant flowing to the cryogenic energy generation route 42 with respect to the refrigerant flowing through the refrigerant circulation line 3.

The circulation system flow rate control unit 76 obtains a flow rate ratio set value R' which is pre-stored and the flow rate ratio R, derives the opening rate (manipulation amount) of the circulation system JT valve 36 so that a deviation between the flow rate ratio R and the flow rate ratio set value R' becomes zero, and outputs this opening rate.

The switch 77 switches an opening rate command for the circulation system JT valve 36 based on whether the load factor of the liquefier 20 is constant or changing. Note that the load factor may be regarded as constant when a changing magnitude of the load factor of the liquefier 20 is a predetermined threshold or less, and may be regarded as changing when the changing magnitude is more than the predetermined threshold.

The load factor [%] is proportional to the refrigerant pressure at the entrance of the high-pressure expansion unit 37. For example, in a case where the entrance pressure in the high-pressure expansion unit 37 corresponding to the load factor of 50% is P50, the entrance pressure in the high-pressure expansion unit 37 corresponding to the load factor of 100% is P100, and the entrance pressure in the high-pressure expansion unit 37 which is detected by the pressure sensor 55 is P, the load factor x can be derived according to the following formula (equation):

$$x=[(P-2\times P50+P100)\times 50]/(P100-P50)$$

In a case where the load factor is constant, a present (current) opening rate command for the circulation system JT valve 36 is output as the opening rate command for the circulation system JT valve 36. In other words, in a case where the load factor in the liquefier 20 is constant, the opening rate of the circulation system JT valve 36 is fixed so that a pressure change does not occur in the refrigerant circulation line 3.

On the other hand, in a case where the load factor is changing, the command output from the circulation system flow rate control unit 76 is output as the opening rate command for the circulation system JT valve 36. For example, in a case where the flow rate ratio R is higher than the flow rate ratio set value R', the amount of generation of cryogenic energy in the cryogenic energy generation route 42 is excessive and cooling is excessive. In light of this, in the above-described control, the flow rate in the refrigerant liquefaction route 41 is increased, namely, the opening rate of the circulation system JT valve 36 is increased so that the flow rate ratio R approaches (gets close to) the flow rate ratio set value R'. For example, in a case where the flow rate ratio R is lower than the flow rate ratio set value R', the amount of generation of cryogenic energy in the cryogenic energy generation route 42 is insufficient and cooling is insufficient. In light of this, the flow rate in the refrigerant liquefaction route 41 is reduced, namely, the opening rate of the circulation system JT valve 36 is reduced so that the flow rate ratio R approaches (gets close to) the flow rate ratio set value R'.

In accordance with the above-described processing performed by the circulation system JT valve opening rate control section 62, even in a case where the load factor changes, the ratio (flow rate ratio) of the refrigerant flowing to the cryogenic energy generation route 42 is held (kept) at the predetermined value. This makes it possible to stabilize the amount of generation of cryogenic energy (cold energy) in the refrigerant circulation line 3.

[Processing Performed by Feed System JT Valve Opening Rate Control Section 61]

Figure 4:
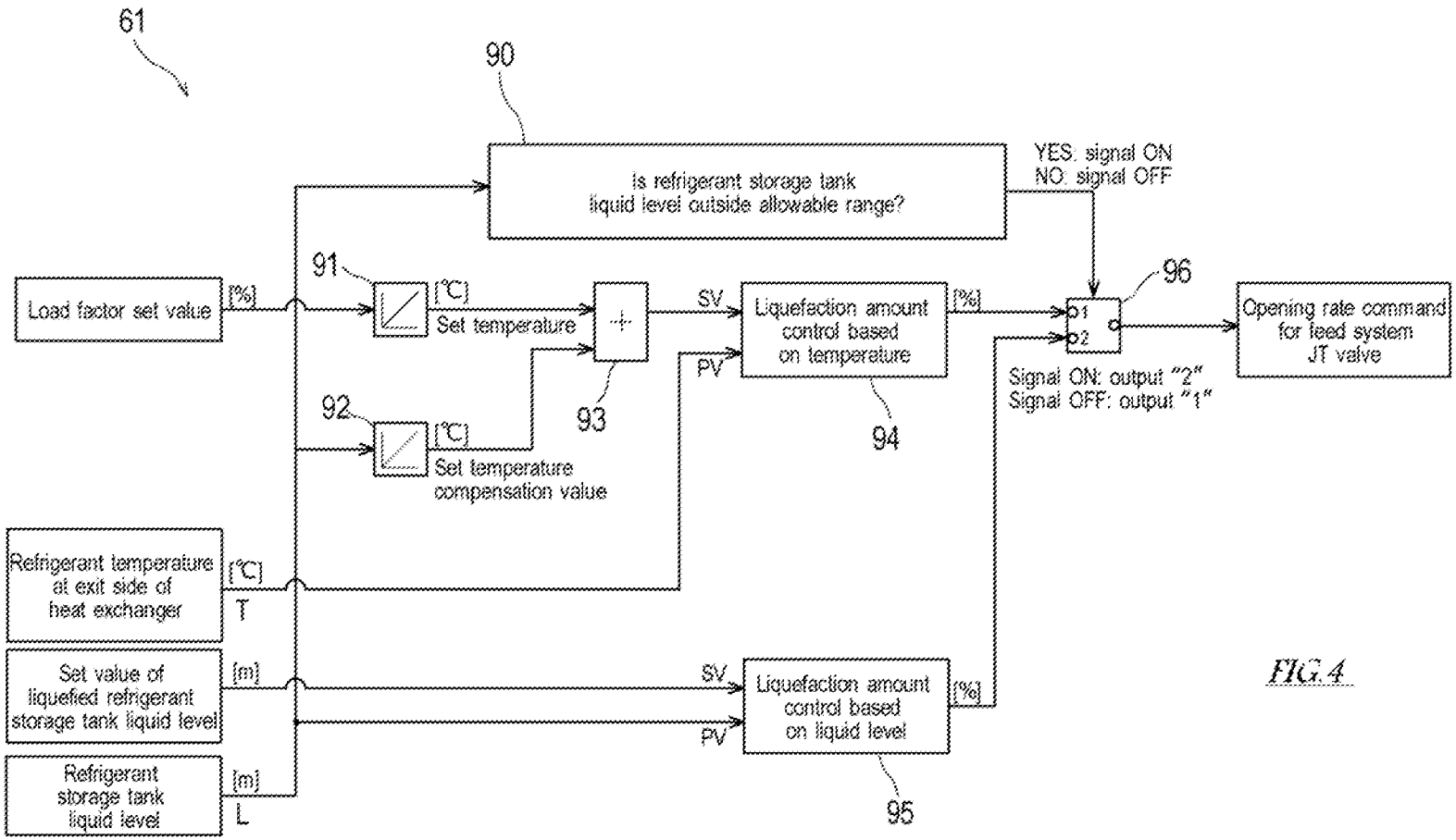
FIG. 4 is a view for explaining a flow of processing performed by a feed system JT valve opening rate control section.

FIG. 4 is a view for explaining a flow of the processing performed by the feed system JT valve opening rate control section 61. As shown in FIG. 4, the feed system JT valve opening rate control section 61 of the controller 6 includes a control method determination unit 90, a set temperature calculator 91, a set temperature compensation amount calculator 92, an adder 93, a liquefaction amount control unit 94 associated with the temperature, a liquefaction amount control unit 95 associated with the temperature, and a switch 96.

Figure 6:
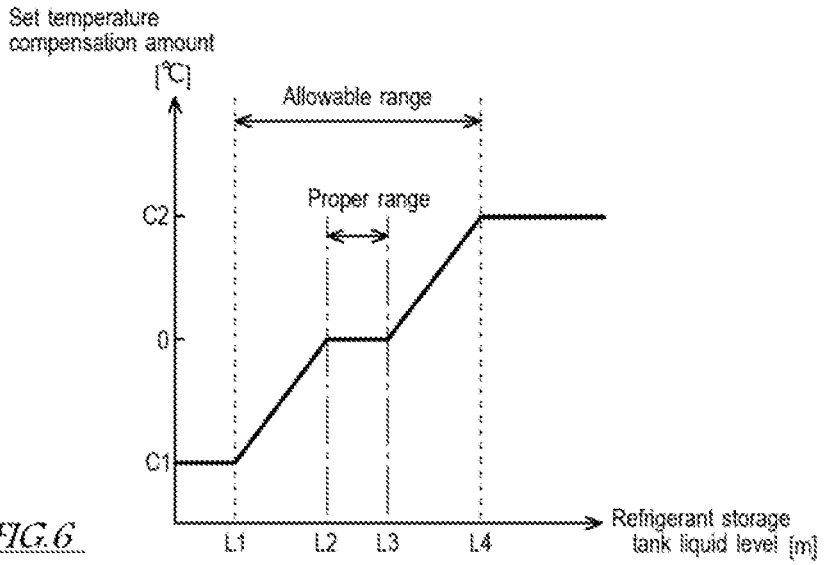
FIG. 6 is a graph showing a relation between a liquid level in a liquefied refrigerant storage tank and a set temperature compensation amount.

The control method determination unit 90 determines whether to execute a liquid level control in which a priority is given to the refrigerant storage tank liquid level L or to execute a temperature control in which a priority is given to a cycle balance, as the control for the opening rate of the feed system JT valve 16. As shown in FIG. 6, an allowable (permissible) range of the refrigerant storage tank liquid level L is set. The allowable range of the liquid level is set to a lower limit value L1 [m] or more and an upper limit value L4[m] or less. Note that the allowable range of the liquid level includes a proper range of the liquid level. The proper range of the liquid level is set to a lower limit value L2 [m] or more and an upper limit value L3[m] or less (L1<L2<L3<L4). The lower limit value L2 [m] may be equal to the upper limit value L3[m], and thus the proper range of the liquid level may be uniquely defined.

The control method determination unit 90 determines whether or not the refrigerant storage tank liquid level L is outside the allowable range. In a case where the control method determination unit 90 determines that the refrigerant storage tank liquid level L is outside the allowable range (L<L1, L4<L), the control method determination unit 90 outputs a command (signal ON) directing the liquid level control. On the other hand, in a case where the control method determination unit 90 determines that the refrigerant storage tank liquid level L is within the allowable range (L1≤L≤L4), the control method determination unit 90 outputs a command (signal OFF) directing the temperature control. The command output from the control method determination unit 90 is input to the switch 96. The switch 96 selects which of the liquefaction amount control unit 94 associated with the temperature and the liquefaction amount control unit 95 associated with the liquid level outputs the opening rate command to the feed system JT valve 16.

(Liquid Level Control for Opening Rate of Feed System JT Valve 16)

Initially, the liquid level control performed for the opening rate of the feed system JT valve 16 will be described. In a case where the refrigerant storage tank liquid level L is outside the allowable range (L<L1, L4<L), the feed system JT valve opening rate control section 61 manipulates the opening rate of the feed system JT valve 16 to control the refrigerant storage tank liquid level L so that the refrigerant storage tank liquid level L quickly falls into the allowable range.

Specifically, the liquefaction amount control unit 95 associated with the liquid level obtains the refrigerant storage tank liquid level L and a liquid level set value L', derives the opening rate (manipulation amount) so that a deviation between the refrigerant storage tank liquid level L and the liquid level set value L' becomes zero, and outputs the opening rate command to the feed system JT valve 16. The liquid level set value L' is a value (L1≤L'≤L4) within the allowable range of the liquid level, preferably, a value (L2≤L'≤L3) within the proper range of the liquid level.

In accordance with the above-described control, in a case where the refrigerant storage tank liquid level L is lower than the lower limit value L1 [m] of the allowable range, the opening rate command for reducing the opening rate of the feed system JT valve 16 is output. In response to this, the flow rate (liquefaction amount) in the feed line 1 is reduced, and thus the cryogenic energy is provided to the refrigerant circulation line 3. In this way, the liquefaction yield (cooling ability) of the refrigerant circulation line 3 can be increased, and the refrigerant storage tank liquid level L can fall into the allowable range. On the other hand, in a case where the refrigerant storage tank liquid level L is higher than the upper limit value L4 [m] of the allowable range, the opening rate command for increasing the opening rate of the feed system JT valve 16 is output. In response to this, the liquefaction yield (cooling ability) of the refrigerant circulation line 3 is reduced, and thus the cryogenic energy is provided to the feed line 1. In this way, the flow rate (liquefaction amount) in the feed line 1 can be increased and the refrigerant storage tank liquid level L can fall into the allowable range.

(Temperature Control for Opening Rate of Feed System JT Valve 16)

Next, the temperature control performed for the opening rate of the feed system JT valve 16 will be described. In a case where the refrigerant storage tank liquid level L is within the allowable range, the feed system JT valve opening rate control section 61 manipulates the opening rate of the feed system JT valve 16 so that the cryogenic energy with a certain amount generated in the cryogenic energy generation route 42 is distributed to the feed line 1 and the refrigerant liquefaction route 41 of the refrigerant circulation line 3 so as to stabilize the cycle balance. The cryogenic energy provided to the feed line 1 is the cryogenic energy (namely, heat energy (calories) transferred from the raw material gas to the refrigerant in the low-temperature-side refrigerant flow paths) shifted to the raw material gas in the high-temperature-side raw material flow paths of the heat exchangers 81 to 86. The cryogenic energy provided to the refrigerant liquefaction route 41 is the cryogenic energy (namely, heat energy (calories) transferred from the refrigerant in the high-temperature-side refrigerant flow paths to the refrigerant in the low-temperature-side refrigerant flow paths) shifted to the refrigerant in the high-temperature-side refrigerant flow paths of the heat exchangers 81 to 86. There is a relation between the cryogenic energy provided to the feed line 1 and the cryogenic energy provided to the refrigerant liquefaction route 41, in which when one of them reduces, the other increases.

Specifically, the set temperature calculator 91 obtains a specified load factor set value in the liquefier 20, derives the set temperature of the refrigerant temperature T at the exit side of the heat exchangers 81 to 86 based on the load factor set value, and outputs the set temperature to the adder 93. In the present embodiment, "the refrigerant temperature T at the exit side" is defined as the temperature at the exit side of the high-temperature-side refrigerant flow paths of the heat exchangers 81 to 86 which cool the raw material gas (and the refrigerant) by utilizing the cryogenic energy generated in the cryogenic energy generation route 42 of the refrigerant circulation line 3. In the present embodiment, "the refrigerant temperature T at the exit side" is the temperature of the refrigerant having flowed through all of the high-temperature-side refrigerant flow paths of the heat exchangers 81 to 86 at six stages (the refrigerant temperature at the entrance of the circulation system JT valve 36).

Figure 5:
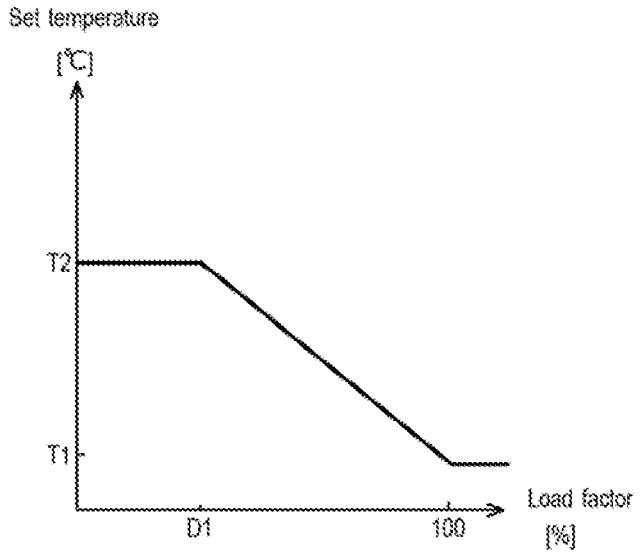
FIG. 5 is a graph showing a relation between a load factor (load rate) set value and a set temperature of a refrigerant.

A relation between the load factor and the set temperature (e.g., formula, map, or table) for uniquely calculating the set temperature from the load factor is pre-stored in the set temperature calculator 91. The graph of FIG. 5 represents the relation between the load factor and the set temperature of the refrigerant. In this graph, a vertical axis indicates the set temperature and a horizontal axis indicates the load factor. The set temperature of the refrigerant temperature at the exit side of the heat exchangers 81 to 86 is T2 [degrees C.] and constant in a range in which the load factor is from zero to D1[%], decreases from T2 [degrees C.] to T1 [degrees C.] in a linear function manner in a range in which the load factor is from D1[%] to 100[%], and is T1 [degrees C.] and constant in a range in which the load factor is more than 100[%] (T1<T2).

While the opening rate of the feed system JT valve 16 is manipulated based on the refrigerant temperature T at the exit side of the heat exchangers 81 to 86, the refrigerant storage tank liquid level L changes. In light of this, the above-described set temperature is compensated with the set temperature compensation amount associated with the refrigerant storage tank liquid level L to keep the refrigerant storage tank liquid level L within the allowable range. By associating the refrigerant storage tank liquid level L with the liquefaction amount in the feed system JT valve 16 in the control, a good cycle balance between the feed line 1 and the refrigerant circulation line 3 is kept.

Specifically, the set temperature compensation amount calculator 92 obtains the refrigerant storage tank liquid level L, derives the set temperature compensation amount based on the refrigerant storage tank liquid level L, and outputs the set temperature compensation amount to the adder 93. A relation between the set temperature compensation amount and the refrigerant storage tank liquid level L (e.g., formula, map, or table) for uniquely calculating the set temperature compensation amount from the refrigerant storage tank liquid level L, is pre-stored in the set temperature compensation amount calculator 92. The graph of FIG. 6 represents the relation between the set temperature compensation amount and the refrigerant storage tank liquid level L. In this graph, a vertical axis indicates the set temperature compensation amount and a horizontal axis indicates the refrigerant storage tank liquid level L. The set temperature compensation amount is C1 [degrees C.] when the refrigerant storage tank liquid level L is L1 [m], increases from C1 [degrees C.] to 0 [degree C.] in a linear function manner in a range in which the refrigerant storage tank liquid level L is from L1 [m] to L2[m], is 0 [degree C.] in the proper range in which the refrigerant storage tank liquid level L is from L2[m] to L3[m], increases from 0 [degree C.] to C2 [degrees C.] in a linear function manner in a range in which the refrigerant storage tank liquid level L is from L3[m] to L4[m], and is C2 [degrees C.] when the refrigerant storage tank liquid level L is L4[m] (C1<0<C2).

The adder 93 outputs a sum of the set temperature and the set temperature compensation amount as a temperature set value T' to the liquefaction amount control unit 94 associated with the temperature. In a case where the refrigerant storage tank liquid level L is within the proper range, the set temperature is the temperature set value T'. The liquefaction amount control unit 94 obtains the refrigerant temperature (the refrigerant temperature at the entrance of the circulation system JT valve 36) T at the exit side of the heat exchangers 81 to 86, derives the opening rate (manipulation amount) of the feed system JT valve 16 so that a deviation between the refrigerant temperature T and the temperature set value T' becomes zero, and outputs the opening rate command directing this opening rate to the feed system JT valve 16.

In the above-described control, in a case where the refrigerant storage tank liquid level L is within the proper range (L2≤L≤L3), the set temperature compensation amount is zero, and the opening rate of the feed system JT valve 16 is decided so that the refrigerant temperature T at the exit side of the heat exchangers 81 to 86 reaches the set temperature corresponding to the load factor of the liquefier 20. In a case where the refrigerant storage tank liquid level L exceeds the proper range (L3<L≤L4), the opening rate command for increasing the opening rate of the feed system JT valve 16 is output. In response to this, the cooling ability (liquefaction yield) of the refrigerant circulation line 3 is reduced, the corresponding cryogenic energy is provided to the feed line 1 to increase the flow rate (liquefaction amount) in the feed line 1, and the refrigerant storage tank liquid level L falls into the proper range. In a case where the refrigerant storage tank liquid level L is less than the proper range (L1≤L<L2), the opening rate command for reducing the opening rate of the feed system JT valve 16 is output. In response to this, the flow rate (liquefaction amount) in the feed line 1 is reduced, the corresponding cryogenic energy is provided to the refrigerant circulation line 3, and the refrigerant storage tank liquid level L falls into the proper range.

As described above, the raw material gas liquefying device 100 of the present embodiment includes the feed line 1, the refrigerant circulation line 3, and the controller 3. In the feed line 1, the raw material gas whose boiling temperature is lower than that of the nitrogen gas, flows through the raw material flow paths of the heat exchangers 81 to 86, the liquefied refrigerant storage tank 40 which stores therein the liquefied refrigerant, and the feed system JT valve 16 in this order. The refrigerant circulation line 3 includes the circulation flow paths which are the refrigerant liquefaction route 41 and the cryogenic energy generation route 42 which partially share the flow paths. In the refrigerant liquefaction route 41, the refrigerant flows through the compressors 32, 33, the high-temperature-side refrigerant flow paths of the heat exchangers 81 to 86, the circulation system JT valve 36, the liquefied refrigerant storage tank 40, and the first low-temperature-side refrigerant flow paths of the heat exchangers 86 to 81, in this order, and returns to the compressor 32. In the cryogenic energy generation route 42, the refrigerant flows through the compressor 33, the expansion units 37, 38, and the second low-temperature-side refrigerant flow paths of the heat exchangers 85 to 81, in this order, and returns to the compressor 33. The raw material gas liquefying device 100 is provided with the temperature sensor 53 which directly or indirectly detects the refrigerant temperature T at the exit side of the high-temperature-side refrigerant flow paths of the heat exchangers 81 to 86, and the liquid level sensor 54 which detects the liquid level (the refrigerant storage tank liquid level L) in the liquefied refrigerant storage tank 40.

In the raw material gas liquefying device 100, the controller 6 determines whether or not the refrigerant storage tank liquid level L is within the predetermined allowable range, manipulates the opening rate of the feed system JT valve 16 to control the temperature (the refrigerant temperature T at the exit side of the high-temperature-side refrigerant flow paths of the heat exchangers 81 to 86) detected by the temperature sensor 53 so that this temperature reaches the predetermined temperature set value, in a case where the refrigerant storage tank liquid level L is within the predetermined allowable range, and manipulates the opening rate of the feed system JT valve 16 to control the refrigerant storage tank liquid level L so that the level L falls into the predetermined allowable range, in a case where the refrigerant storage tank liquid level L is outside the predetermined allowable range.

In the method of controlling the raw material gas liquefying device 100 of the present embodiment, the opening rate of the feed system JT valve 16 is manipulated so that the refrigerant storage tank liquid level L which is the liquid level in the liquefied refrigerant storage tank 40 falls into the predetermined allowable range, in a case where the refrigerant storage tank liquid level L is outside the predetermined allowable range, and the opening rate of the feed system JT valve 16 is manipulated so that the refrigerant temperature T at the exit side of the high-temperature-side refrigerant flow paths of the heat exchangers 81 to 86 reaches the predetermined temperature set value, in a case where the refrigerant storage tank liquid level L is within the predetermined allowable range.

In accordance with the raw material gas liquefying device 100 and the control method thereof (therefor), described above, in a case where the refrigerant storage tank liquid level L is outside the predetermined allowable range, the refrigerant storage tank liquid level L is preferentially caused to fall into the predetermined allowable range. This allows the refrigerant storage tank liquid level L to quickly fall into the predetermined allowable range irrespective of the initial position of the refrigerant storage tank liquid level L. Thus, the refrigerant storage tank liquid level L is easily stabilized. On the other hand, in a case where the refrigerant storage tank liquid level L is within the predetermined allowable range, the opening rate of the feed system JT valve 16 is manipulated so that the refrigerant temperature T at the exit side of the heat exchangers 81 to 86 reaches the predetermined temperature set value. The predetermined temperature set value is set to a value at which a cycle balance between the feed line 1 and the refrigerant circulation line 3 is stabilized. Therefore, in accordance with the above-described control, the cryogenic energy generated in the refrigerant circulation line 3 can be distributed to the feed line 1 and the refrigerant circulation line 3 so that the cycle balance is stabilized. Since the temperature of the refrigerant flowing into the circulation system JT valve 36 is stabilized, the liquefaction amount in the feed system JT valve 16 is stabilized, and hence the refrigerant storage tank liquid level L is easily stabilized. Since the cycle balance between the feed line 1 and the refrigerant circulation line 3 can be kept while stabilizing the refrigerant storage tank liquid level L, the liquefied raw material gas can be stably produced.

In accordance with the raw material gas liquefying device 100 and the control method thereof (therefor), according to the above-described embodiment, the temperature set value is associated with the load factor so that the temperature set value decreases as the load factor increases, and the temperature set value derived based on the set value of the load factor is used.

Thus, the temperature set value derived based on the set value of the load factor, with which a good cycle balance can be obtained, is used in the control.

In accordance with the raw material gas liquefying device 100 and the control method thereof (therefor), according to the above-described embodiment, the set temperature compensation amount is associated with the refrigerant storage tank liquid level L so that the set temperature compensation amount is zero in a case where the refrigerant storage tank liquid level L is within the predetermined proper range included in the predetermined allowable range, is a negative value in a case where the refrigerant storage tank liquid level L is lower than the predetermined proper range, and is a positive value in a case where the refrigerant storage tank liquid level L exceeds the predetermined proper range, and the temperature set value is compensated with the set temperature compensation amount derived based on the refrigerant storage tank liquid level L.

Thus, by use of the set temperature compensation amount, the temperature set value is compensated to be increased in a case where the refrigerant storage tank liquid level L is higher than the predetermined proper range (namely, the cryogenic energy in the refrigerant circulation line 3 is excessive), and is compensated to be reduced in a case where the refrigerant storage tank liquid level L is lower than the predetermined proper range (namely, the cryogenic energy in the refrigerant circulation line 3 is insufficient). Therefore, the refrigerant storage tank liquid level L can be kept within the predetermined allowable range while controlling the refrigerant temperature T at the exit side of the heat exchangers 81 to 86 so that the refrigerant temperature T reaches the temperature set value.

In accordance with the raw material gas liquefying device 100 and the control method thereof (therefor), according to the above-described embodiment, the opening rate of the circulation system JT valve 36 is fixed (made constant), in a case where the load factor changes within the predetermined range, and is manipulated to control the flow rate of the refrigerant flowing to the cryogenic energy generation route 42 so that the ratio of the refrigerant flowing to the cryogenic energy generation route 42 with respect to the refrigerant flowing through the refrigerant circulation line 3 reaches the predetermined value, in a case where the load factor changes in a range outside the predetermined range. The raw material gas liquefying device 100 is provided with the flow rate sensors 51, 52 to detect the ratio of the refrigerant flowing to the cryogenic energy generation route 42 with respect to the refrigerant flowing through the refrigerant circulation line 3.

As described above, in a case where the load factor changes, the opening rate (liquefaction amount) of the circulation system JT valve 36 is manipulated so that the ratio of the refrigerant flowing to the cryogenic energy generation route 42 is kept at the predetermined value. This makes it possible to stabilize the amount of the cryogenic energy generated in the cryogenic energy generation route 42 even in a case where the load factor changes.

The load factor and the pressure of the refrigerant flowing into the expansion unit 37 are associated with each other so that the load factor and the pressure are proportional to each other. The load factor derived based on the pressure of the refrigerant flowing into the expansion unit 37 is used in the control. To derive the load factor, the raw material gas liquefying device 100 is provided with a pressure sensor 55 which detects the pressure of the refrigerant flowing into the expansion unit 37.

Thus far, the preferred embodiment of the present invention has been described. The specific structures and/or the details of the function of the above-described embodiment may be changed within the scope of the invention. For example, the configuration of the raw material gas liquefying device 100 can be changed as follows.

In the above-described embodiment, the balance between the amount of cryogenic energy provided to the feed line 1 and the amount of cryogenic energy provided to the refrigerant liquefaction route 41 is adjusted by use of the refrigerant temperature T at the exit side of the high-temperature-side refrigerant flow paths of the heat exchangers 81 to 86. The temperature sensor 53 is provided on the flow path at the exit side of the heat exchangers 81 to 86 which cool the raw material gas by utilizing the cryogenic energy generated in the refrigerant liquefaction route 41 of the refrigerant circulation line 3, to be precise, the flow path at the exit side of the heat exchanger 86 at the final stage (sixth stage). Alternatively, the balance between the amount of cryogenic energy provided to the feed line 1 and the amount of cryogenic energy provided to the refrigerant liquefaction route 41 may be adjusted by use of the refrigerant temperature at the exit side or entrance side of any one of the high-temperature-side refrigerant flow paths of the heat exchangers 83 to 85 other than the heat exchanger 86 at the final stage (sixth stage) so long as the refrigerant temperature is at a location that is downstream of the branch part 31*d* of the high-pressure flow path 31.

Figure 7:
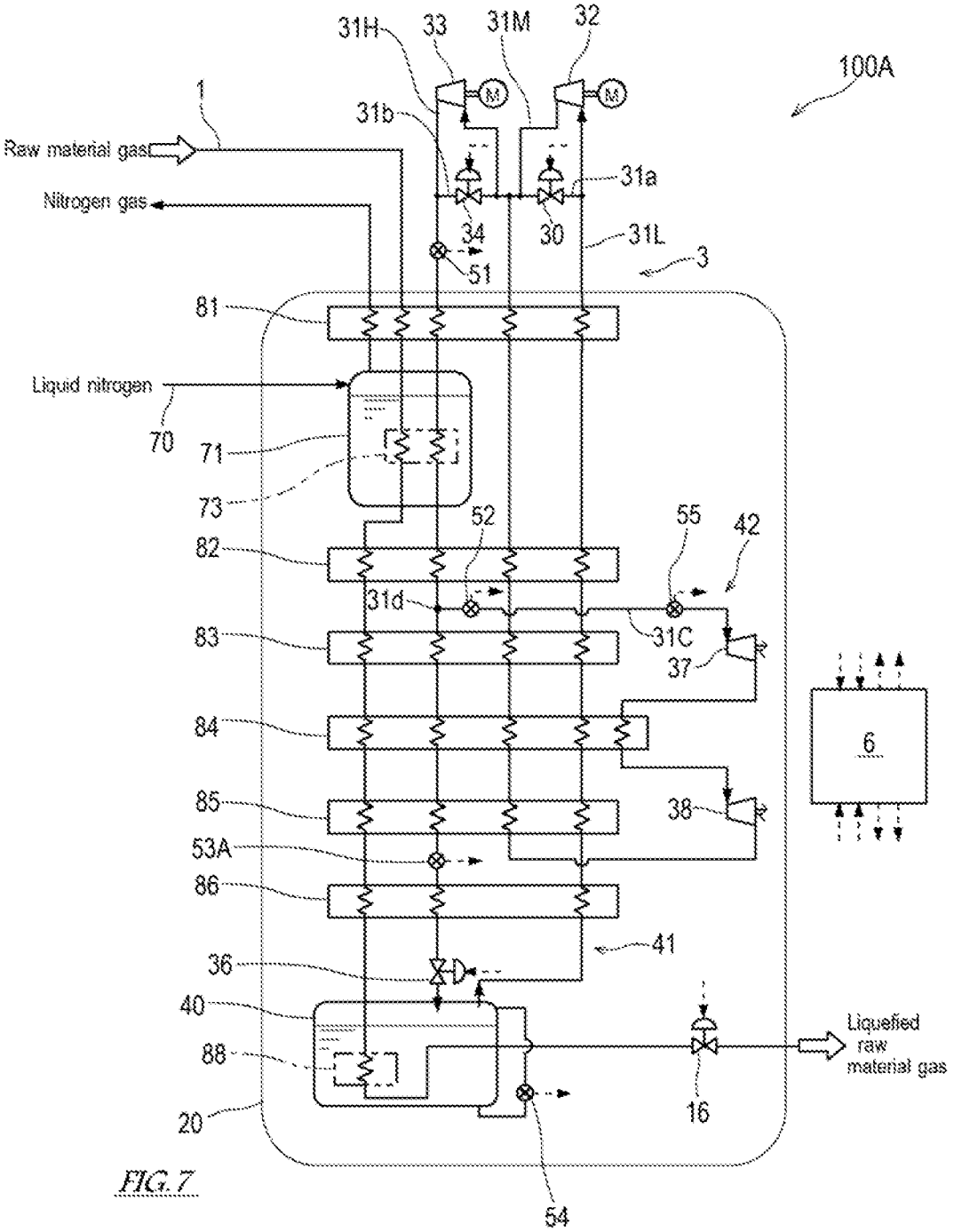
FIG. 7 is a view showing the overall configuration of a raw material gas liquefying device according to Modified Example 1.

For example, in a raw material gas liquefying device 100A according to Modified Example 1 shown in FIG. 7, a temperature sensor 53A is provided between the heat exchanger 85 at the fifth stage and the heat exchanger at the sixth stage in the refrigerant liquefaction route 41 of the refrigerant circulation line 3. This temperature sensor 53A detects the refrigerant temperature at the exit side of the high-temperature-side refrigerant flow path of the heat exchanger 85 at the fifth stage (or the refrigerant temperature at the entrance side of the high-temperature-side refrigerant flow path of the heat exchanger 86 at the sixth stage). The controller 6 of the raw material gas liquefying device 100A manipulates the opening rate of the feed system JT valve 16 based on the detection value of the temperature sensor 53A and the temperature set value corresponding to this detection value to control the refrigerant temperature at the exit side of the high-temperature-side refrigerant flow path of the heat exchanger 85 at the fifth stage, as in the above-described embodiment.

In the raw material gas liquefying device 100 according to the above-described embodiment, the balance between the amount of cryogenic energy provided to the feed line 1 and the amount of cryogenic energy provided to the refrigerant liquefaction route 41 is adjusted by use of the temperature (the refrigerant temperature T at the exit side of the high-temperature-side refrigerant flow paths of the heat exchangers 81 to 86) of the refrigerant flowing through the refrigerant liquefaction route 41. The cryogenic energy with a certain amount generated in the cryogenic energy generation route 42 is distributed to the feed line 1 and the refrigerant liquefaction route 41. Therefore, the balance between the amount of cryogenic energy provided to the feed line 1 and the amount of cryogenic energy provided to the refrigerant liquefaction route 41 may be adjusted by use of the temperature of the raw material gas flowing through the feed line 1.

Figure 8:
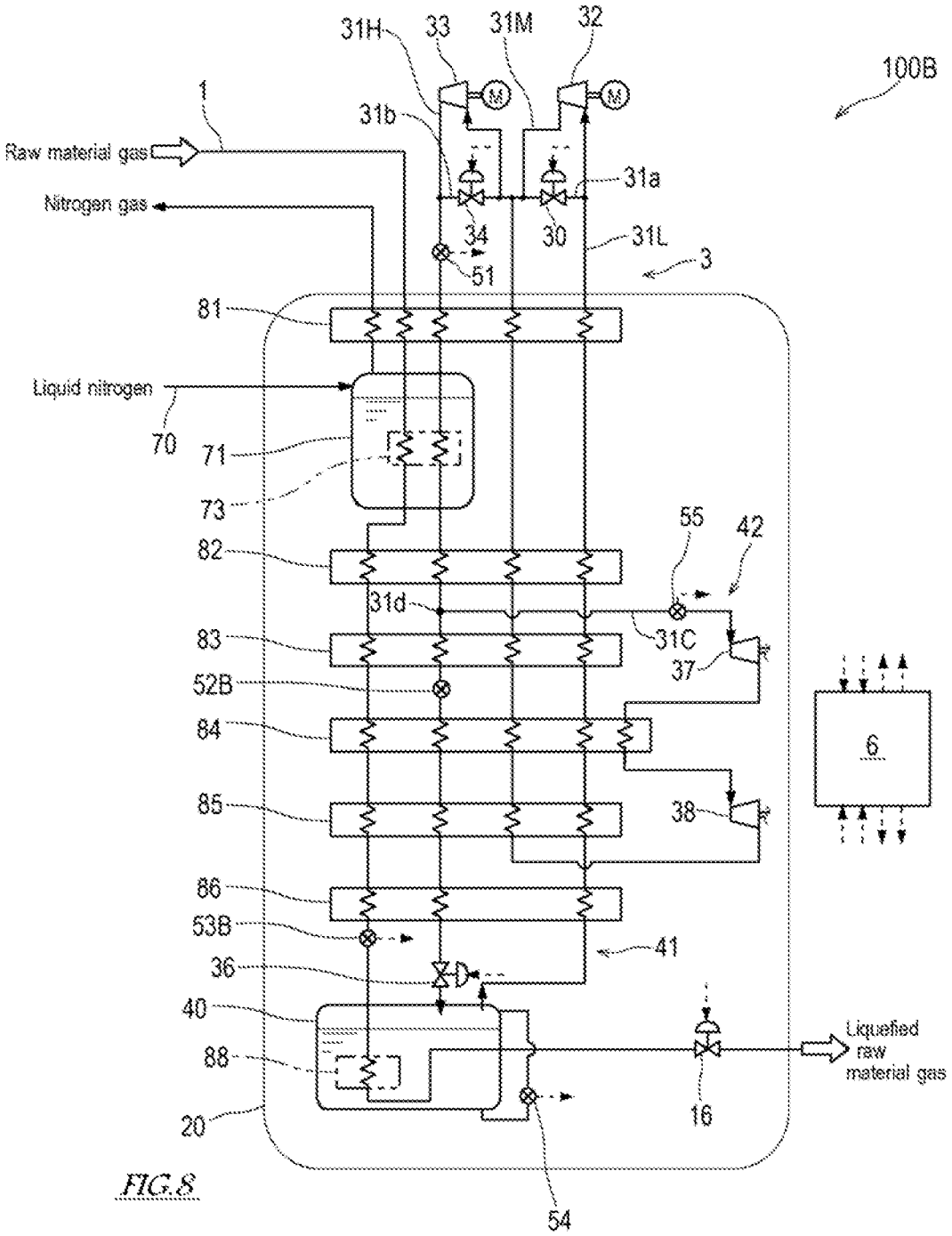
FIG. 8 is a view showing the overall configuration of a raw material gas liquefying device according to Modified Example 2.
Figure 9:
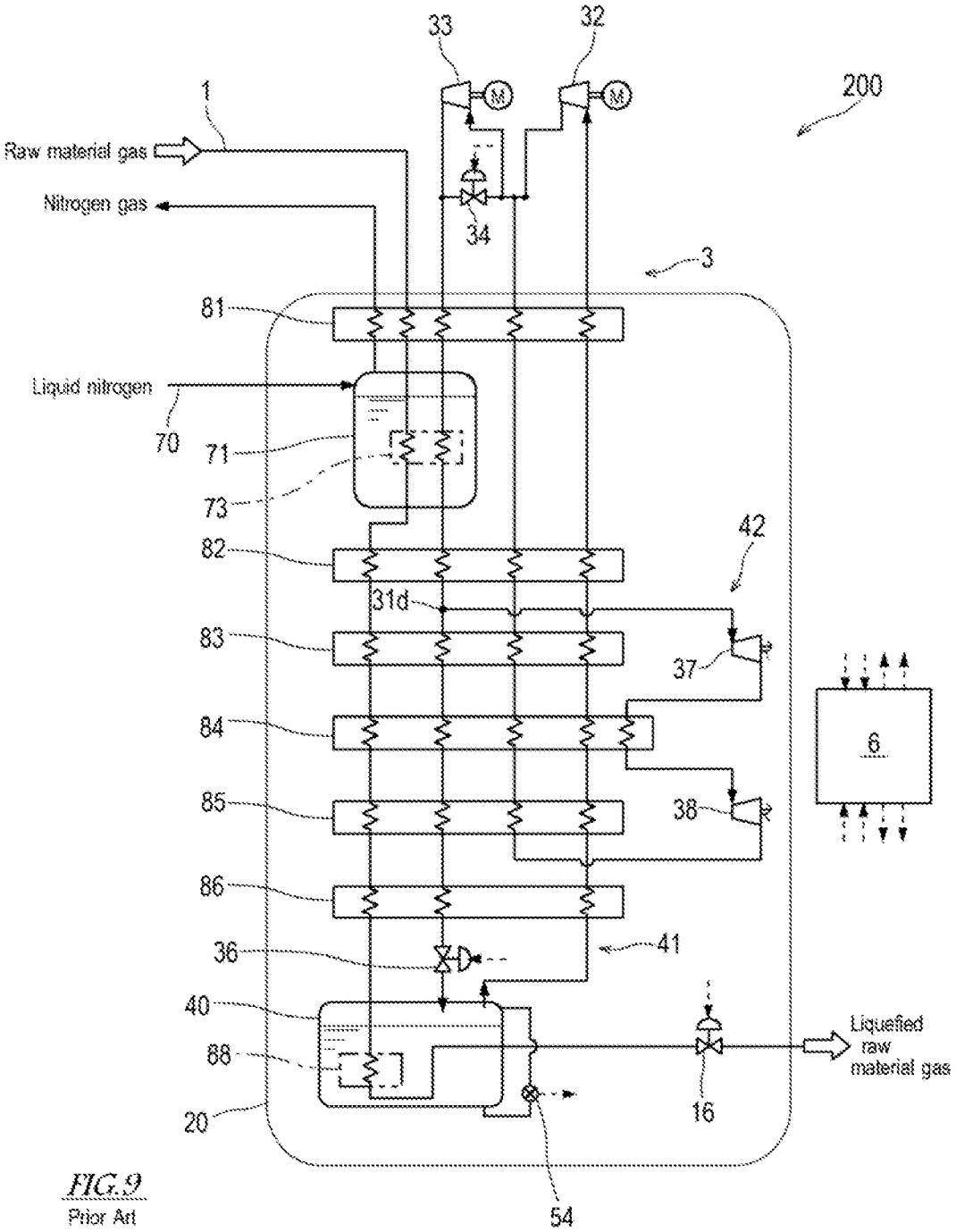
FIG.9 Prior Art
FIG. 9 is a view showing the overall configuration of a conventional raw material gas liquefying device.

For example, in a raw material gas liquefying device 100B according to Modified Example 2 shown in FIG. 8, a temperature sensor 53B is provided on the feed line 1, to detect the temperature of the raw material gas at the exit side of the raw material flow paths of the heat exchangers 81 to 86. Specifically, in the feed line 1, the temperature sensor 53B which detects the temperature of the raw material gas is provided at a location that is between the heat exchanger 86 at the final stage (sixth stage) and the cooler 88. The controller 6 of the raw material gas liquefying device 100B manipulates the opening rate of the feed system JT valve 16 to control the temperature of the raw material gas which is detected by the temperature sensor 53B so that this temperature reaches a predetermined temperature set value, by use of the detection value of the temperature sensor 53B and the temperature set value corresponding to this detection value, as in the above-described embodiment.

In the raw material gas liquefying device 100 according to the above-described embodiment, the ratio of the refrigerant flowing to the cryogenic energy generation route 42 with respect to the refrigerant flowing through the refrigerant circulation line 3, is detected by use of the flow rate sensor 51 provided at the entrance of the heat exchanger 81 at the first stage in the high-pressure flow path 31H of the refrigerant circulation line 3 and the flow rate sensor 52 provided at the entrance of the high-pressure expansion unit 37 of the cryogenic energy generation flow path 31C. Alternatively, the ratio of the refrigerant flowing to the cryogenic energy generation route 42 with respect to the refrigerant flowing through the refrigerant circulation line 3, may be detected by use of a flow rate sensor provided at another location.

For example, in a raw material gas liquefying device 100B according to Modified Example 2 shown in FIG. 8, the flow rate sensor 51 is provided at the entrance of the heat exchanger 81 at the first stage in the high-pressure flow path 31H, and a flow rate sensor 52B is provided at a location that is downstream of the branch part 31*d* of the high-pressure flow path 31H. In this case, the controller 6 can derive the ratio of the refrigerant flowing to the cryogenic energy generation route 42 with respect to the refrigerant flowing through the refrigerant circulation line 3, based on the detection values of the flow rate sensors 51, 52B. Alternatively, a flow rate sensor may be provided at the entrance of the high-pressure expansion unit 37 of the cryogenic energy generation flow path 31C, a flow rate sensor may be provided at a location that is downstream of the branch part 31*d* of the high-pressure flow path 31H, and the ratio of the refrigerant flowing to the cryogenic energy generation route 42 with respect to the refrigerant flowing through the refrigerant circulation line 3, may be derived based on the detection values of these sensors.

In the raw material gas liquefying device 100 according to the above-described embodiment, two compressors 32, 33, and two expansion units 37, 38 are provided. The number of them depends on performance of the compressors 32, 33, and the expansion units 37, 38 and is not limited to two of the above-described embodiment. Further, although the raw material gas liquefying device 100 according to the above-described embodiment includes the heat exchangers 81 to 86 at six stages, the number of the heat exchangers 81 to 86 is not limited to this.

REFERENCE SIGNS LIST

1 feed line
3 refrigerant circulation line
6 controller
16 feed system JT valve
20 liquefier
30, 34 bypass valve
31C cryogenic energy generation flow path
31H high-pressure flow path
31L low-pressure flow path
31M medium-pressure flow path
31*a*, 31*b* first bypass flow path
31*d* branch part
32, 33 compressor
36 circulation system JT valve
37, 38 expansion unit
40 liquefied refrigerant storage tank
41 refrigerant liquefaction route
42 cryogenic energy generation route
51, 52 flow rate sensor
53 temperature sensor
54 liquid level sensor
55 pressure sensor
61 feed system JT valve opening rate control section
62 circulation system JT valve opening rate control section
63 bypass valve opening rate control section
70 nitrogen line
73 cooler for preliminary cooling
75 divider
76 circulation system flow rate control unit
77 switch
81 to 86 heat exchanger
88 cooler
90 control method determination unit
91 set temperature calculator
92 set temperature compensation amount calculator
93 adder
94 liquefaction amount control unit
95 liquefaction amount control unit
96 switch

The invention claimed is:

1. A raw material gas liquefying device comprising:

a feed line in which a raw material gas flows through a raw material flow path in order from a heat exchanger, to a liquefied refrigerant storage tank which stores a liquefied refrigerant therein, and to a feed system Joule-Thomson valve;

a refrigerant circulation line including a refrigerant liquefaction route and a cryogenic energy generation route, wherein in the refrigerant liquefaction route, a refrigerant flows through a compressor, then in order from the compressor to a high-temperature-side refrigerant flow path of the heat exchanger, to a circulation system Joule-Thomson valve, the liquefied refrigerant storage tank, and to a first low-temperature-side refrigerant flow path of the heat exchanger, and then returns to the compressor, and while in the cryogenic energy generation route, the refrigerant flows through the compressor, then in order from the compressor to an expansion unit, and to a second low-temperature-side refrigerant flow path of the heat exchanger, and then returns to the compressor;

a temperature sensor which detects a temperature, which is either: (i) a first temperature of the refrigerant at an exit side of the high-temperature-side refrigerant flow path of the heat exchanger; or (ii) a second temperature of the raw material gas at an exit side of the raw material flow path of the heat exchanger;

a liquid level sensor which detects a refrigerant storage tank liquid level which is a liquid level in the liquefied refrigerant storage tank; and a controller which determines whether or not the refrigerant storage tank liquid level is within a predetermined allowable range or outside the predetermined allowable range, and wherein in a case where the liquid level is outside a predetermined allowable range, the controller manipulates an opening rate of the feed system Joule-Thomson valve based on the liquid level so that the liquid level falls into the predetermined allowable range; and in a case where the liquid level is within the predetermined allowable range, the controller manipulates the opening rate of the feed system Joule-Thomson valve based on the temperature detected by the temperature sensor so that the temperature reaches a predetermined temperature set value.

2. The raw material gas liquefying device according to claim 1, wherein the predetermined temperature set value is associated with a load factor so that the predetermined temperature set value decreases as the load factor increases, and wherein the controller uses the predetermined temperature set value derived based on a set value of the load factor.

3. The raw material gas liquefying device according to claim 2, wherein a set temperature compensation amount is associated with the refrigerant storage tank liquid level so that the set temperature compensation amount is zero in a case where the refrigerant storage tank liquid level is within a predetermined proper range included in the predetermined allowable range, is a negative value in a case where the refrigerant storage tank liquid level is less than the predetermined proper range, and is a positive value in a case where the refrigerant storage tank liquid level exceeds the predetermined proper range, and wherein the controller derives the set temperature compensation amount based on the refrigerant storage tank liquid level, and uses the predetermined temperature set value compensated with the set temperature compensation amount.

4. The raw material gas liquefying device according to claim 1, further comprising:

a flow rate sensor which detects a ratio of the refrigerant flowing to the cryogenic energy generation route with respect to the refrigerant flowing through the refrigerant circulation line, wherein the controller sets an opening rate of the circulation system Joule-Thomson valve to a fixed value in a case where a load factor changes within a predetermined range, and manipulates the opening rate of the circulation system Joule-Thomson valve to control a flow rate of the refrigerant flowing to the cryogenic energy generation route so that the ratio of the refrigerant flowing to the cryogenic energy generation route with respect to the refrigerant flowing through the refrigerant circulation line reaches a predetermined value in a case where the load factor changes in a range outside the predetermined range.

5. The raw material gas liquefying device according to claim 4, wherein the load factor is associated with a pressure of the refrigerant flowing into the expansion unit so that the load factor is proportional to the pressure of the refrigerant flowing into the expansion unit, the raw material gas liquefying device further comprising:

a pressure sensor which detects the pressure of the refrigerant flowing into the expansion unit, wherein the controller uses the load factor derived based on the pressure of the refrigerant flowing into the expansion unit.

6. A method of controlling a raw material gas liquefying device including:

a feed line in which a raw material gas flows through a raw material flow path in order from a heat exchanger, to a liquefied refrigerant storage tank which stores a liquefied refrigerant therein, and to a feed system Joule-Thomson valve; and a refrigerant circulation line including a refrigerant liquefaction route and a cryogenic energy generation route, wherein in the refrigerant liquefaction route, a refrigerant flows through a compressor, then in order from the compressor to a high-temperature-side refrigerant flow path of the heat exchanger, to a circulation system Joule-Thomson valve, to the liquefied refrigerant storage tank, and to a first low-temperature-side refrigerant flow path of the heat exchanger, and then returns to the compressor, and while in the cryogenic energy generation route, the refrigerant flows through the compressor, then in order from the compressor to an expansion unit, and to a second low-temperature-side refrigerant flow path of the heat exchanger, and then returns to the compressor, the method comprising:

sensing a liquid level in the liquefied refrigerant storage tank;

in a case where the liquid level is outside a predetermined allowable range, manipulating an opening rate of the feed system Joule-Thomson valve based on the liquid level so that the liquid level falls into the predetermined allowable range;

sensing a temperature, which is either: (i) a first temperature of the refrigerant at an exit side of the high-temperature-side refrigerant flow path of the heat exchanger; or (ii) a second temperature of the raw material gas at an exit side of the raw material flow path of the heat exchanger; and in a case where the liquid level is within the predetermined allowable range, manipulating the opening rate of the feed system Joule-Thomson valve based on the temperature so that the temperature reaches a predetermined temperature set value.

7. The method of controlling the raw material gas liquefying device according to claim 6, wherein the predetermined temperature set value is associated with a load factor so that the predetermined temperature set value decreases as the load factor increases, and wherein the predetermined temperature set value is derived based on a set value of the load factor.

8. The method of controlling the raw material gas liquefying device according to claim 7, wherein a set temperature compensation amount is associated with the refrigerant storage tank liquid level so that the set temperature compensation amount is zero in a case where the refrigerant storage tank liquid level is within a predetermined proper range included in the predetermined allowable range, is a negative value in a case where the refrigerant storage tank liquid level is less than the predetermined proper range, and is a positive value in a case where the refrigerant storage tank liquid level exceeds the predetermined proper range, and wherein the predetermined temperature set value is compensated with the set temperature compensation amount derived based on the refrigerant storage tank liquid level.

9. The method of controlling the raw material gas liquefying device according to claim 6, further comprising:

setting an opening rate of the circulation system Joule-Thomson valve to a fixed value in a case where a load factor changes within a predetermined range, and manipulating the opening rate of the circulation system Joule-Thomson valve to control a flow rate of the refrigerant flowing to the cryogenic energy generation route so that a ratio of the flow rate of the refrigerant flowing to the cryogenic energy generation route which branches off from the refrigerant circulation line with respect to a flow rate of the refrigerant flowing through the refrigerant circulation line reaches a predetermined value, in a case where the load factor changes in a range outside the predetermined range.

10. The method of controlling the raw material gas liquefying device according to claim 9, wherein the load factor is associated with a pressure of the refrigerant flowing into the expansion unit so that the load factor is proportional to the pressure of the refrigerant flowing into the expansion unit, and wherein the load factor is derived based on the pressure of the refrigerant flowing into the expansion unit.

* * * * *